US012709865B2

(12) United States Patent
Sato et al.

(10) Patent No.: US 12,709,865 B2
(45) Date of Patent: Aug. 18, 2026

(54) WORK MACHINE

(71) Applicant: KUBOTA CORPORATION, Osaka (JP)

(72) Inventors: Ken Sato, Osaka (JP); Yosuke Hayashi, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 353 days.

(21) Appl. No.: 18/385,429

(22) Filed: Oct. 31, 2023

(65) Prior Publication Data

US 2024/0209594 A1 Jun. 27, 2024

(30) Foreign Application Priority Data

Dec. 26, 2022 (JP) ..... 2022-208881

(51) Int. Cl.
*E02F 9/00* (2006.01)
*E02F 9/16* (2006.01)

(52) U.S. Cl.
CPC ..... *E02F 9/16* (2013.01)

(58) Field of Classification Search
CPC E02F 9/16; B62D 27/04; B62D 24/02; B62D 33/0604; B62D 33/0617; B62D 33/0608
USPC ..... 296/190.08
See application file for complete search history.

(56) References Cited

U.S. PATENT DOCUMENTS 5,286,081 A * 2/1994 Martin, Jr. ..... B62D 33/0621 296/190.08
10,611,413 B2 * 4/2020 Yamanaka ..... B66C 13/54
2021/0291914 A1 * 9/2021 Sasaki ..... B62D 33/0617
2023/0202568 A1 * 6/2023 Sato ..... B62D 24/02 296/187.01

FOREIGN PATENT DOCUMENTS

CN 202755392 U 2/2013
CN 111851619 A 10/2020
GB 2 024 113 A 1/1980
JP 50-134901 U 11/1975
JP 60-177348 U 11/1985
(Continued)

OTHER PUBLICATIONS

European Search Report dated May 8, 2024 issued in counterpart European family member application No. 23206559.9.
(Continued)

*Primary Examiner* — Steven O Douglas
(74) *Attorney, Agent, or Firm* — GREENBLUM & BERNSTEIN, P.L.C.

(57) ABSTRACT

Provided is a work machine which makes an outside noise less likely to enter a cabin of the work machine. The work machine includes: a machine body; a footplate installed on the machine body; and a cabin installed on the footplate. The cabin has, at a bottom portion of a peripheral wall of the cabin, a mounting portion extending toward an inner side of the cabin, and is fixed to the footplate by screwing the mounting portion to an outer edge portion of the footplate in a state where the mounting portion is in contact with the outer edge portion. A sealing material is disposed between the mounting portion and the outer edge portion in a state where the sealing material elastically deforms.

9 Claims, 9 Drawing Sheets

(56) References Cited

FOREIGN PATENT DOCUMENTS

| | | | |
|---|---|---|---|
| JP | 6-17450 | A | 1/1994 |
| JP | 06-136787 | A | 5/1994 |
| JP | 2001-81811 | | 3/2001 |
| JP | 2011-69189 | | 4/2011 |

OTHER PUBLICATIONS

Office Action, dated Aug. 26, 2025 in Japanese family member application No. 2022-208881, with English language (machine) translation thereof.

* cited by examiner

WORK MACHINE

This Nonprovisional application claims priority under 35 U.S.C. § 119 on Patent Application No. 2022-208881 filed in Japan on Dec. 26, 2022, the entire contents of which are hereby incorporated by reference.

TECHNICAL FIELD

The present invention relates to, for example, a work machine such as an excavator.

BACKGROUND ART

Conventionally, a work machine has been known which outputs an alarming sound in association with the traveling of the work machine (for example, Patent Literature 1). An operator of such a work machine is exposed to various noises generated due to work, as well as the alarming sound. In a case of a work machine which is provided with a cabin for covering an operator seat, the cabin shuts out the sounds. This can reduce the noises that reach the operator.

The cabin is mounted on an upper surface of a footplate which is a floor of the operator seat with use of bolts or the like. A peripheral wall of the cabin has a bottom portion provided with a mounting portion having a frame shape extending toward an inner side of the cabin. The cabin is fixed to the footplate by screwing the mounting portion of the cabin to an outer edge portion of the footplate in a state where the mounting portion is in contact with the outer edge portion. Both the mounting portion and the footplate are sheet metals. Thus, the screwing brings the sheet metals into close contact with each other, thereby sealing a contact portion between the sheet metals. A gap at the contact portion between the sheet metals is set to zero as a standard dimension.

CITATION LIST

Patent Literature

[Patent Literature 1]
Japanese Patent Application Publication, Tokukaihei, No. 6-17450

SUMMARY OF INVENTION

Technical Problem

However, even when such a gap is set to zero as a standard dimension, actually, a gap occurs at the contact portion. This gap occurs due to bending of the footplate caused by, for example, weights of installation components, such as an operator seat installed on the footplate and a weight of the operator seated on the operator seat. The gap occurring at the contact portion lets an outside noise enter the cabin through the gap and thus causes an increase in a noise near the ears of the operator.

An aspect of the present invention is achieved in light of the foregoing problem. It is an object of the aspect of the present invention to provide a work machine which makes an outside noise less likely to enter a cabin of the work machine.

Solution to Problem

In order to solve the foregoing problem, a work machine in accordance with an aspect of the present invention includes: a machine body; a footplate installed on the machine body; and a cabin installed on the footplate, wherein the cabin has, at a bottom portion of a peripheral wall of the cabin, a mounting portion extending toward an inner side of the cabin and is fixed to the footplate by screwing the mounting portion to an outer edge portion of the footplate at screwed portions in a state where the mounting portion is in contact with the outer edge portion, and a sealing material is disposed between the mounting portion and the outer edge portion in a state where the sealing material elastically deforms.

Advantageous Effects of Invention

An aspect of the present invention makes it possible to achieve a work machine which makes an outside noise less likely to enter a cabin of the work machine.

DESCRIPTION OF EMBODIMENTS

The following will describe an embodiment of the present invention with reference to drawings as appropriate.

(Outline of Work Machine)

Figure 1:
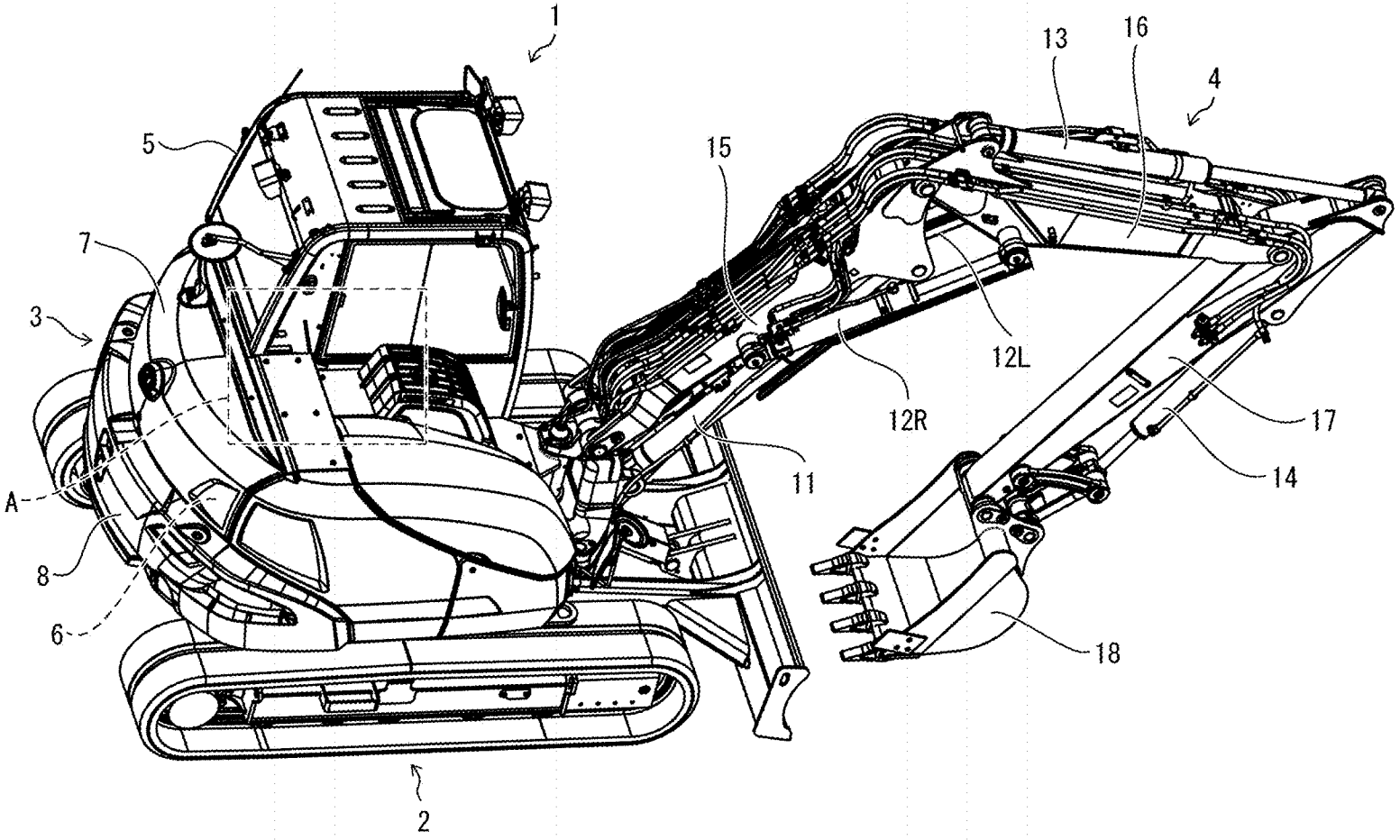
FIG. 1 is a perspective view schematically illustrating an entire configuration of a work machine in accordance with an embodiment of the present invention.
Figure 2:
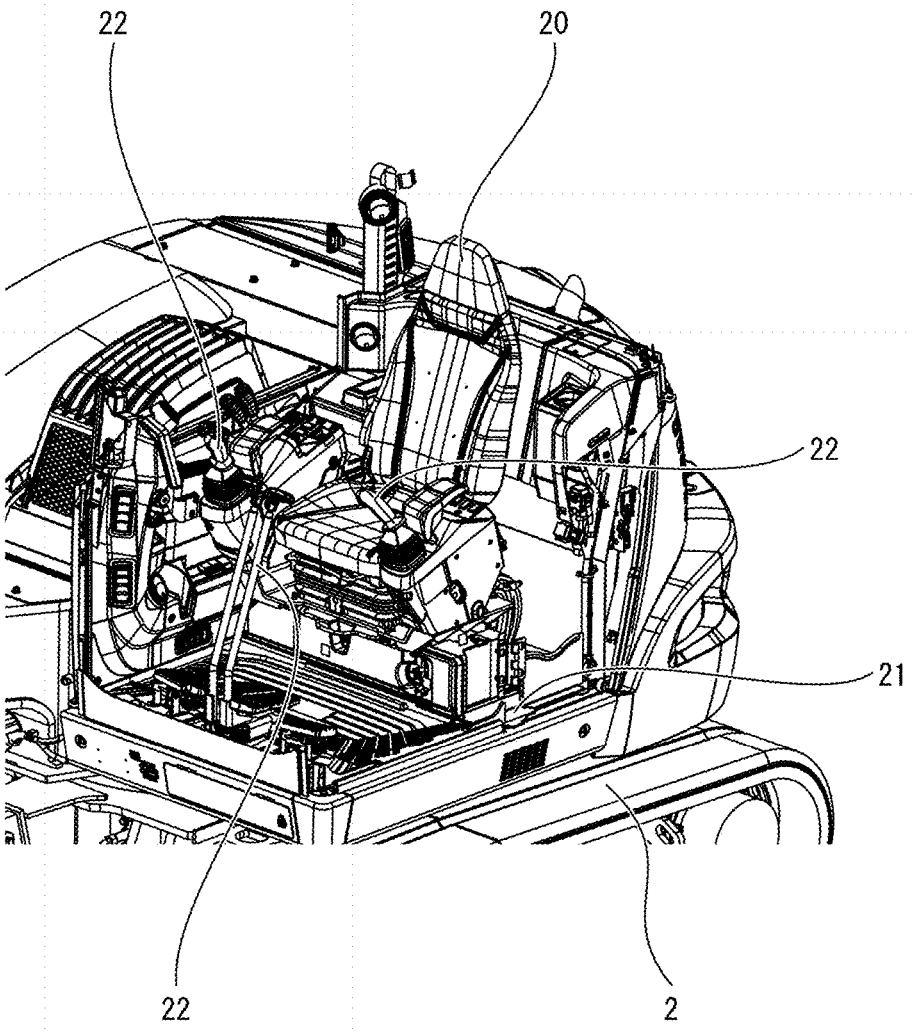
FIG. 2 is a perspective view schematically illustrating an interior of a cabin of the work machine.

FIG. 1 is a perspective view schematically illustrating an entire configuration of a work machine 1 in accordance with the present embodiment. FIG. 2 is a perspective view schematically illustrating an interior of a cabin 5 of the work machine 1. In the present embodiment, an excavator is taken as an example of the work machine 1.

As illustrated in FIG. 1, the work machine 1 includes a traveling device 2, a machine body 3, and a work device 4. The machine body 3 is supported on a frame of the traveling device 2 with a bearing member interposed between the machine body 3 and the frame, so as to be able to swivel about a vertical axis (an axis in an up-and-down direction). Installed in the machine body 3 are a cabin 5, an engine 6, a hood 7, a counterweight 8, the work device 4, and the like.

As illustrated in FIG. 2, an operator seat 20 (installation component) on which an operator (driver) is to be seated is provided in an interior of the cabin 5 (hereinafter, also referred to as "room"). The operator seat 20 is installed on a footplate 21 which is a floor in the room. Disposed around the operator seat 20 are, although not illustrated, a plurality of electronic components (such as a display device and an air conditioner), in addition to the traveling device 2, the work device 4, and a plurality of operation levers 22 for operating the machine body 3. The following description will assume that a front side of the operator seated on the operator seat 20 is the front, a rear side of the operator is the rear, a left side of the operator is the left, and a right side of the operator is the right. The cabin 5 is installed on the machine body 3 so as to be close to a left side of the machine body 3.

As illustrated in FIG. 1, the work device 4 is operated with use of working hydraulic pressures as working fluid pressures and is installed in a front portion of the machine body 3. The work device 4 includes, for example, a first boom 15 rotationally moved by a hydraulic cylinder 11, a second boom 16 rotationally moved by hydraulic cylinders 12R and 12L, an arm 17 rotationally moved by a hydraulic cylinder 13, and a bucket 18 rotationally moved by a hydraulic cylinder 14.

(Mounting of Cabin)

Figure 3:
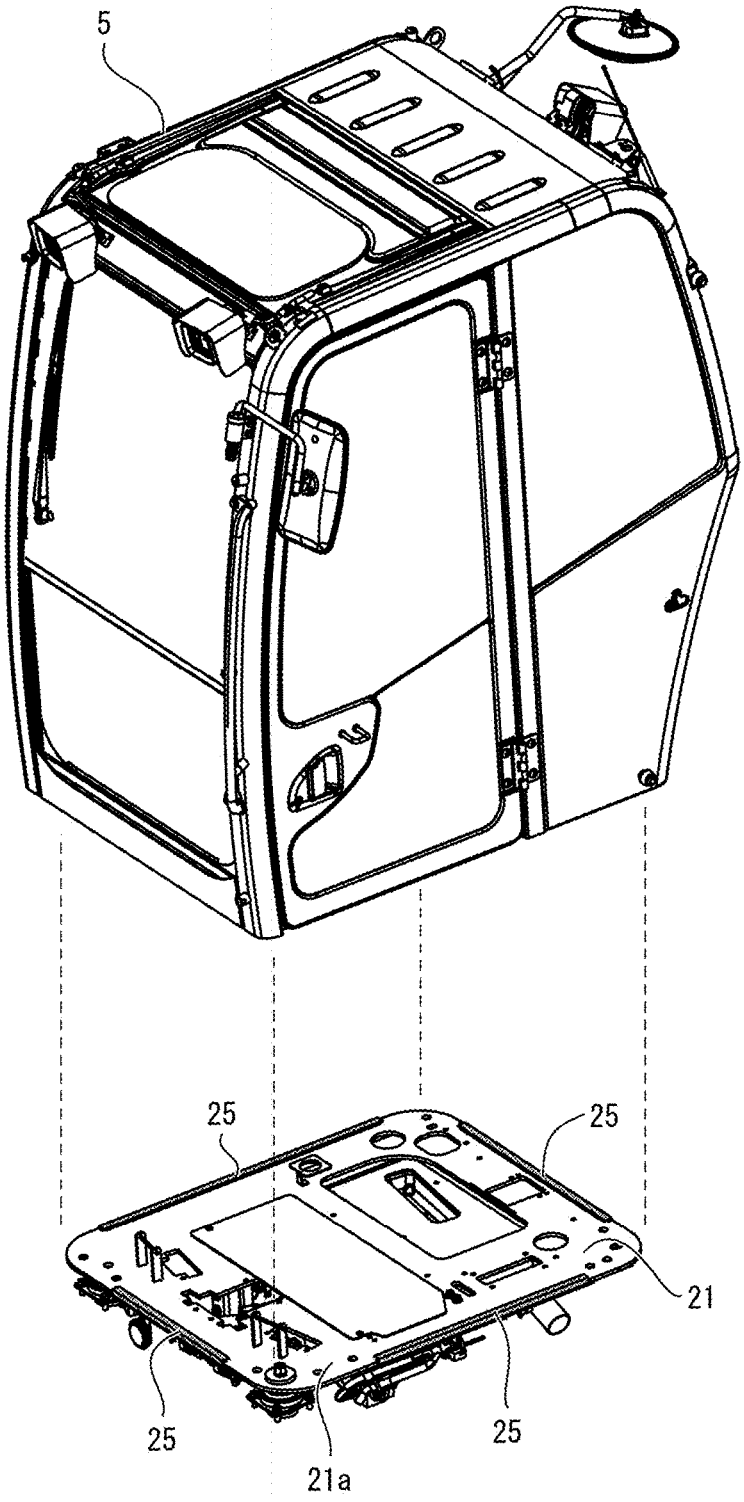
FIG. 3 is a perspective view schematically illustrating the cabin and a footplate in a separated state.
Figure 4:
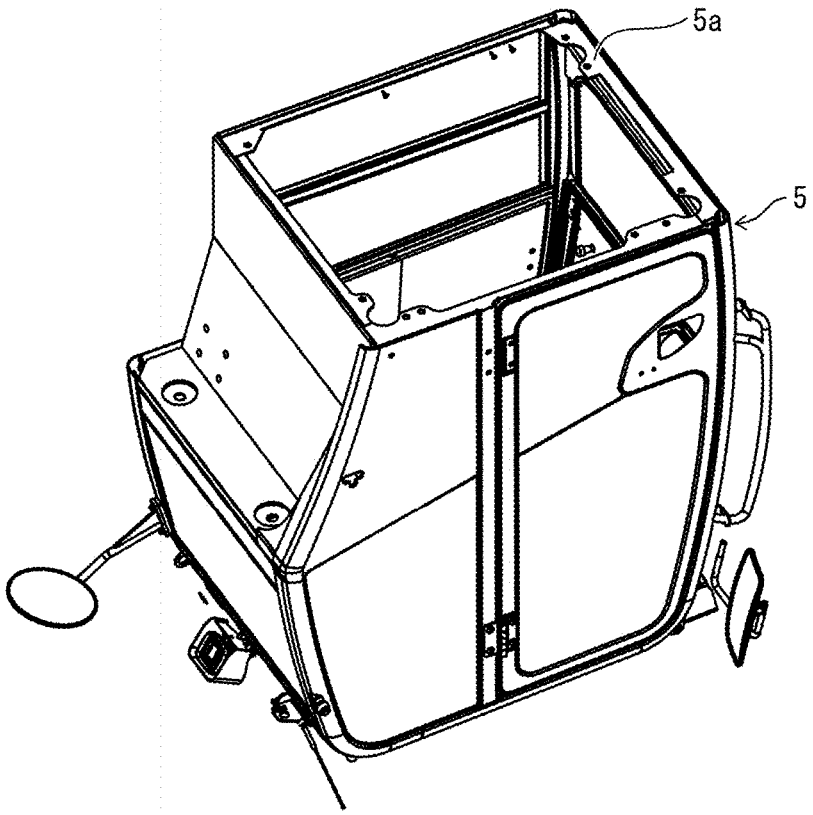
FIG. 4 is a perspective view schematically illustrating the cabin with a bottom surface side thereof facing upward.

FIG. 3 is a perspective view schematically illustrating the cabin 5 and the footplate 21 in a separated state. FIG. 4 is a perspective view schematically illustrating the cabin 5 with a bottom surface side thereof facing upward.

As illustrated in FIG. 3, the cabin 5 is fixed onto the above-described footplate 21 on which the operator seat 20 is installed. As illustrated in FIG. 4, a peripheral wall of the cabin 5 has a bottom portion on which a mounting portion 5*a* is provided so as to extend toward an inner side of the cabin 5. The mounting portion 5*a* has a frame shape. The cabin 5 is fixed to the footplate 21 by screwing the mounting portion 5*a* of the cabin 5 to an outer edge portion 21*a* of the footplate 21 at screwed portions with use bolts or the like in a state where the mounting portion 5*a* is in contact with the outer edge portion 21*a*.

Both the mounting portion 5*a* and the footplate 21 are sheet metals. Thus, in a conventional configuration that does not include a sealing material 25 (described later), the screwing brings the plate metals into close contact with each other, thereby sealing a contact portion between the plate metals. However, as described above, in such a configuration, bending of the footplate 21 is caused by weights of installation components such as the operator seat 20 and a weight of an operator or the like seated on the operator seat 20. Therefore, a gap occurs at a contact portion between the outer edge portion 21*a* of the footplate 21 and the mounting portion 5*a* of the cabin 5.

(Measure Against Gap Caused by Bending of Footplate)

In order to address such a problem, the work machine 1 is provided with the sealing material 25 which is, as illustrated in FIG. 3, disposed between the mounting portion 5*a* and the outer edge portion 21*a* in a state where the sealing material 25 elastically deforms. The sealing material 25 elastically deforms in a state where the cabin 5 is mounted on (screwed to) the footplate 21. The sealing material 25 has an elongated shape extending along an outer edge of the footplate 21 and is made of an elastic material such as rubber. Examples of the sealing material 25 include a rubber sponge.

Even when a gap occurs due to the bending of the footplate 21, the sealing material 25 which is disposed, as described above, between the mounting portion 5*a* and the outer edge portion 21*a* in a state of being elastically deformed by a weight of the cabin 5 mounted on the footplate 21 can restore its original shape and fill the gap. This makes it possible to prevent an outside noise from entering the cabin 5 through the gap caused by the bending of the footplate 21.

More specifically, such a gap due to the bending of the footplate 21 occurs in a location between the screwed portions adjacent to each other. Thus, in the present embodiment, the sealing material 25 is disposed in a location between the screwed portions and between the mounting portion 5*a* and the outer edge portion 21*a*. Note that, although FIG. 3 illustrates, as an example, a configuration in which the sealing material 25 is disposed on the footplate 21, an alternative configuration may be employed in which the sealing material 25 is disposed on the mounting portion 5*a* of the cabin 5. As such, the sealing material 25 is disposed only in a location in which a gap may occur. This can prevent waste of the sealing material 25.

In the present embodiment, the footplate 21 has a substantially quadrangular shape, and the mounting portion 5*a* is screwed to the footplate 21 at four corners of the footplate 21. Therefore, the sealing material 25 is disposed at each of end portions of four sides of the footplate 21 except for the four corners. In such a configuration in which the mounting portion 5*a* is screwed to the footplate 21 at the four corners of the footplate 21, disposing the sealing material 25 at each of the end portions except for the four corners makes it possible to efficiently fill gaps in four directions caused by the bending of the footplate 21.

Figure 5:
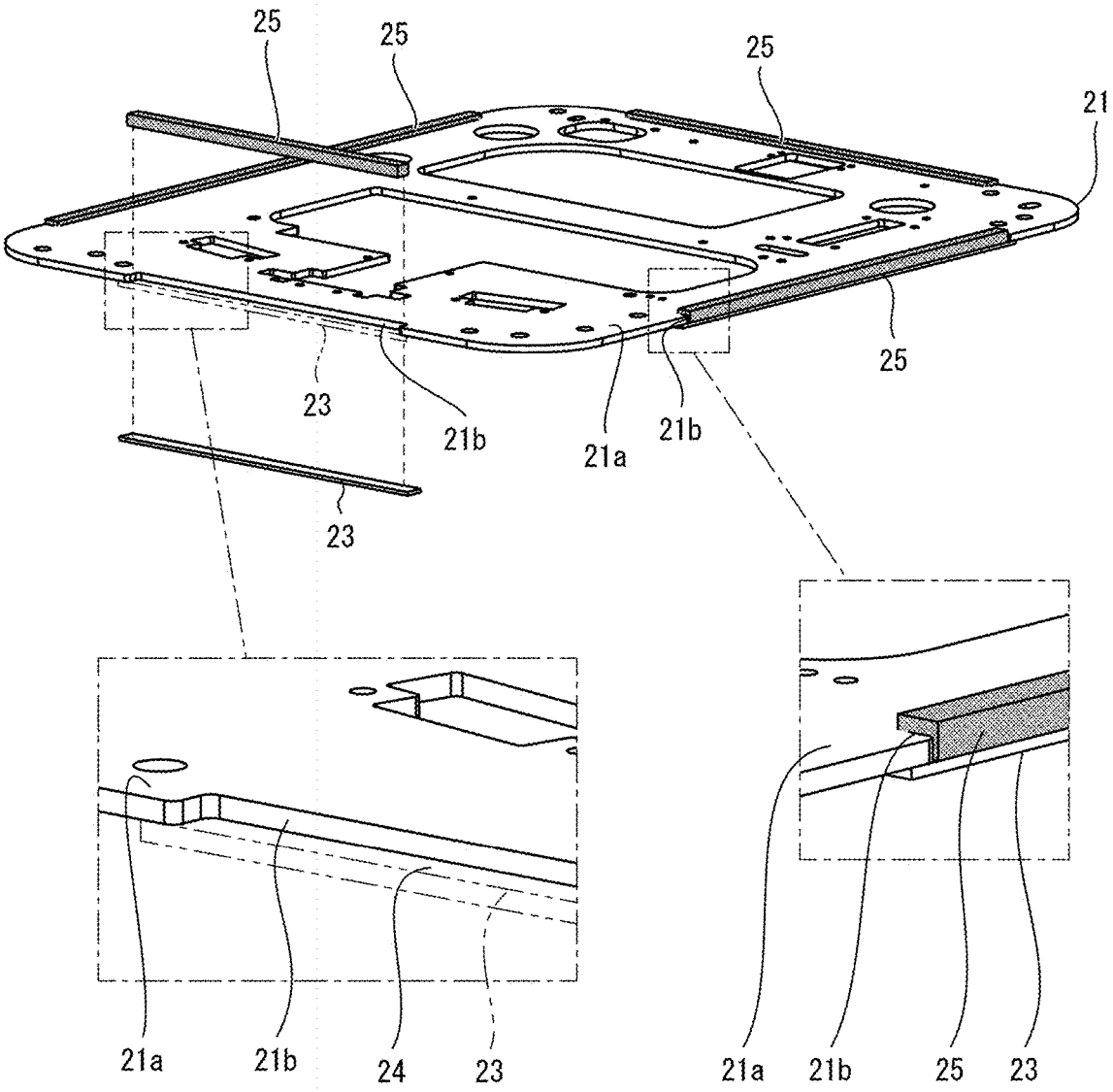
FIG. 5 is a partially exploded perspective view and a partially enlarged view which illustrate a structure in which the sealing material is mounted to the footplate.
Figure 6:
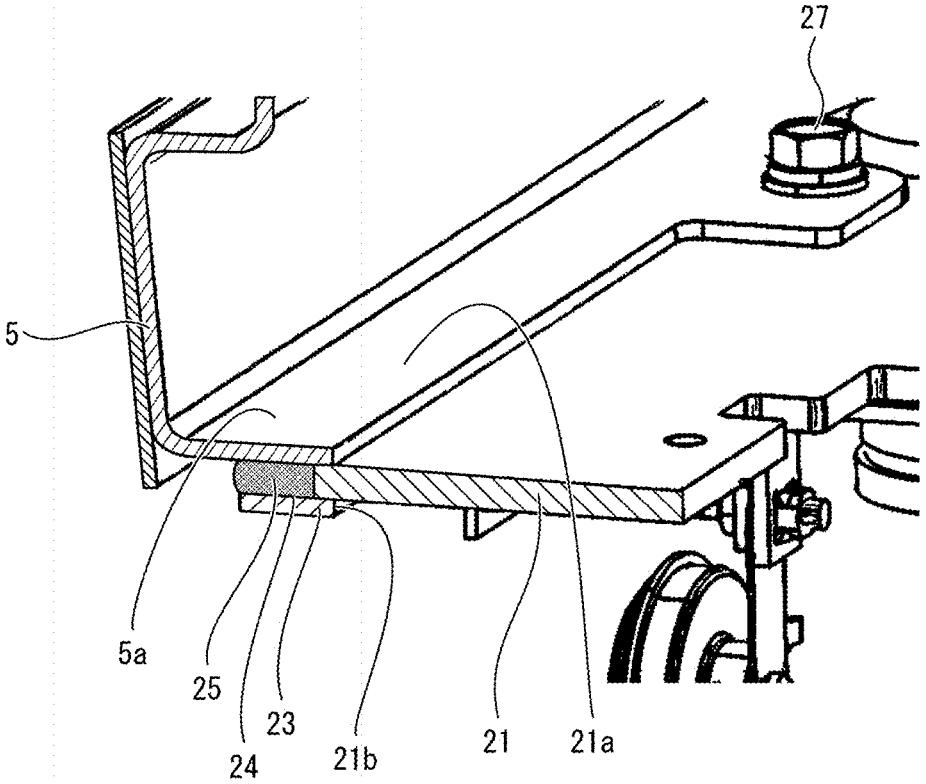
FIG. 6 is a cross-sectional perspective view illustrating a main part of a portion at which the cabin is mounted on the footplate.

FIG. 5 is a partially exploded perspective view and a partially enlarged view which illustrate a structure in which the sealing material 25 is mounted to the footplate 21. FIG. 6 is a cross-sectional perspective view illustrating a main part of a portion at which the cabin 5 is mounted on the footplate 21.

As illustrated in FIGS. 5 and 6, in the present embodiment, the outer edge portion 21*a* has, in a location between the screwed portions, a step portion 24 forming a level difference in a direction away from the mounting portion 5*a*. The sealing material 25 is disposed in the step portion 24. Note that, although FIGS. 5 and 6 illustrate, as an example, a configuration in which the step portion 24 is provided to the footplate 21 on which the sealing material 25 is disposed, an alternative configuration may be employed in which the step portion 24 is provided to the mounting portion 5*a* of the cabin 5, and the sealing material 25 is disposed on the mounting portion 5*a*. That is, it is necessary only that one of the mounting portion 5*a* and the outer edge portion 21*a* has, in the location between the screwed portions, the step portion 24 forming a level difference in a direction away from the other one of the mounting portion 5*a* and the outer edge portion 21*a*, and the sealing material 25 is disposed in the corresponding step portion 24.

In this way, the step portion 24 is provided such that the level of an upper surface of the footplate 21 in a location where the sealing material 25 is disposed is lower than the level of the upper surface of the footplate 21 in a location where the sealing material 25 is not disposed (or the level of a lower surface of the mounting portion 5*a* in a location where the sealing material 25 is disposed is higher than the level of the lower surface of the mounting portion 5*a* in a location where the sealing material 25 is not disposed). This allows the sealing material 25 to be thick and thus provides an adequate amount by which the sealing material 25 is crushed. Thus, even when a change in an amount by which the footplate 21 bends occurs due to, for example, a difference in weight among operators and results in a change in size of the gap, the sealing material 25 changes its shape and size with the change in size of the gap and fills the gap. In addition, the thick sealing material 25 can maintain its elasticity for a longer period of time than a thin sealing material 25 can and thus can secure sealing properties for a longer period of time.

As illustrated in FIG. 5, the step portion 24 provided at the outer edge portion 21*a* is formed by: forming a notch portion 21*b* at the outer edge portion 21*a* so as to extend along the outer edge of the footplate 21; and fixing a support plate 23 to the lower surface of the footplate 21 in such a manner that the support plate 23 covers the notch portion 21*b* from a lower surface side of the footplate 21. In other words, the step portion 24 includes: the notch portion 21*b* extending along the outer edge and the support plate 23 that is fixed to the lower surface of the footplate 21 and that cover the notch part 21*b* from the lower surface side of the footplate 21. The support plate 23 is an elongated plate-metal member having an enough size to cover the notch part 21*b*. The support plate 23 is fixed to the lower surface of the footplate 21 by, for example, welding.

Such a configuration makes it possible to easily achieve the step portion 24 for securing the thickness of the sealing material 25. Note that a similar configuration can be employed in a case where the step portion 24 is provided to the mounting portion 5*a*.

Although not illustrated, the sealing material 25 is disposed on an upper surface of the support plate 23. In a state where the cabin 5 has not yet been mounted on the footplate 21, the upper surface of the sealing material 25 protrudes upward from the upper surface of the footplate 21 through the notch portion 21*b*. This protruding part corresponds to the amount by which the sealing material 25 is crushed when the cabin 5 is mounted.

As illustrated in FIG. 6, when the mounting portion 5*a* of the cabin 5 is mounted on the outer edge portion 21*a* of the footplate 21, the sealing material 25 is pressed by the mounting portion 5*a* and accordingly elastically deforms. In a state where the sealing material 25 elastically deforms, the upper surface of the sealing material 25 is flush with the upper surface of the footplate 21. This results in a state where no gap is present at a contact portion between the outer edge portion 21*a* and the mounting portion 5*a* similarly as at the screwed portions. The sealing material 25 always applies, to the mounting portion 5*a*, a force in an upward direction with use of the restoring force of the sealing material 25.

The sealing material 25 may be an independent member separate from the footplate 21 or the mounting portion 5*a*. Alternatively, the sealing material 25 may be, for example, bonded to or fitted into the footplate 21 or the mounting portion 5*a* in advance to be difficult to detach from the footplate 21 or the mounting portion 5*a*. This can eliminate the need for positioning the sealing material 25 relative to the footplate 21 or the mounting portion 5*a* in a step of installing the cabin 5 on the footplate 21. Thus, the workability is improved.

(Other Measure Against Noise)

The work machine 1 has another path that lets an outside noise enter the cabin 5 as well as the gap caused by the bending of the footplate 21. It is preferable to also fill such a path.

Figure 7:
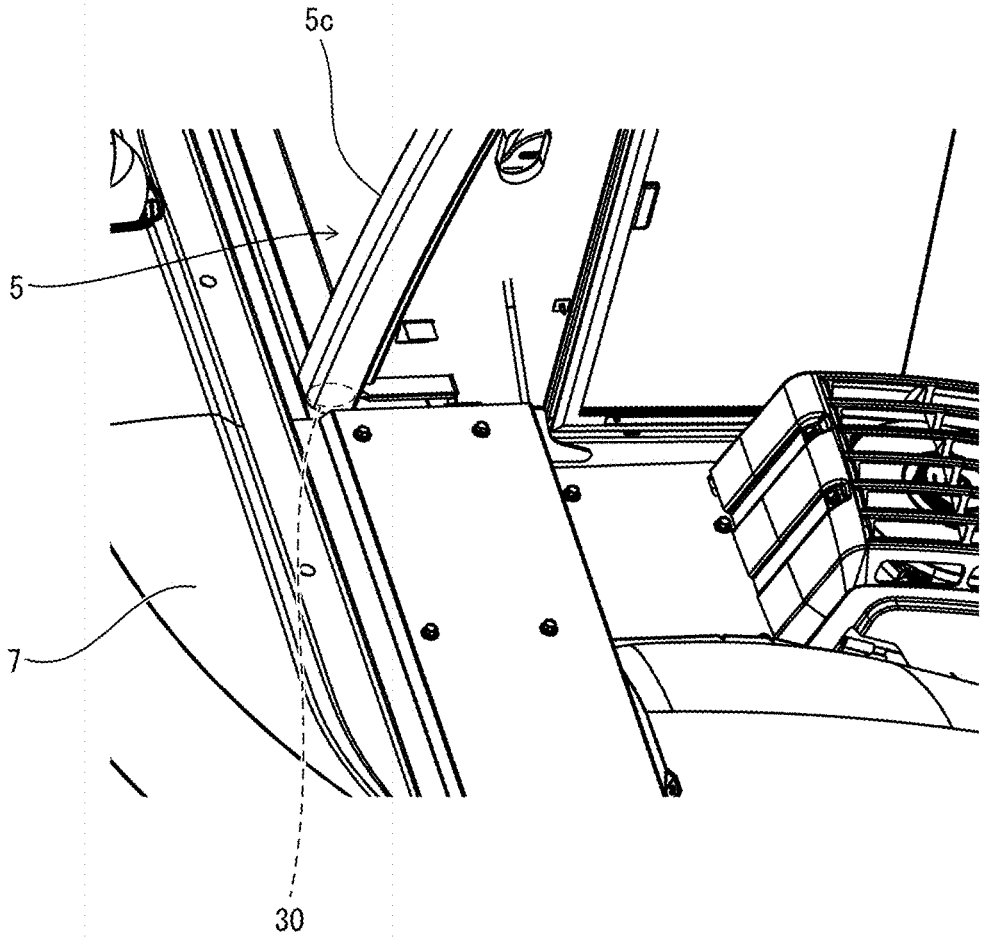
FIG. 7 is an enlarged view of an area A illustrated in FIG. 1.
Figure 8:
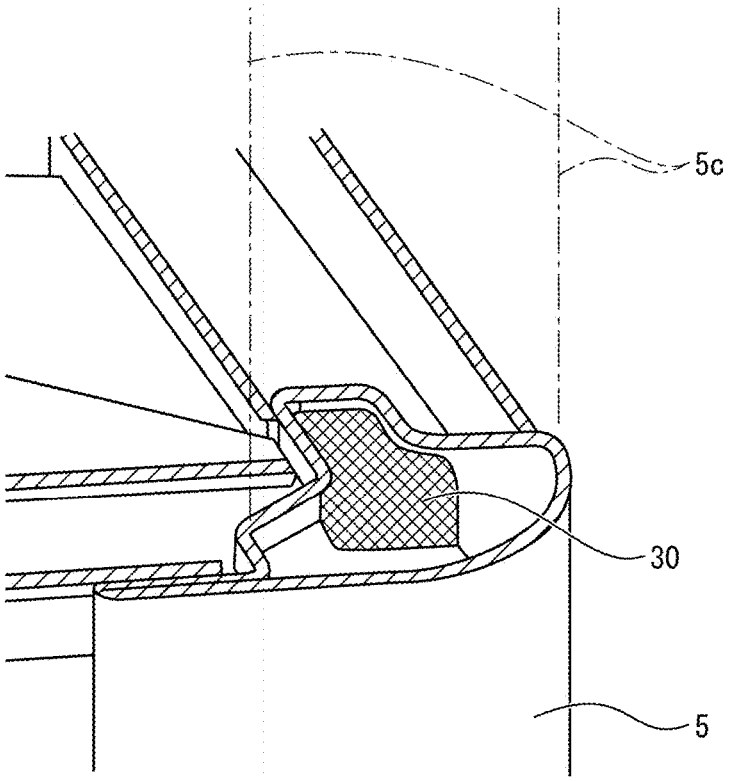
FIG. 8 is a cross-sectional perspective view of a main part that indicates a position of an opening communicating with an outside of the cabin.
Figure 9:
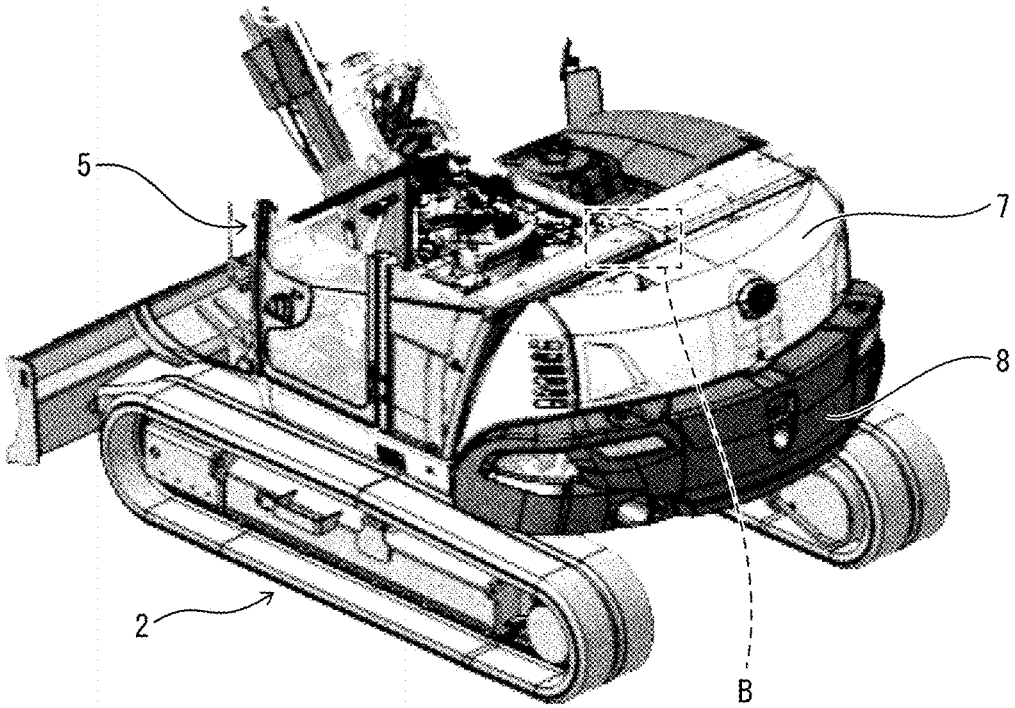
FIG. 9 is a cross-sectional perspective view illustrating the work machine cut along a horizontal plane.
Figure 10:
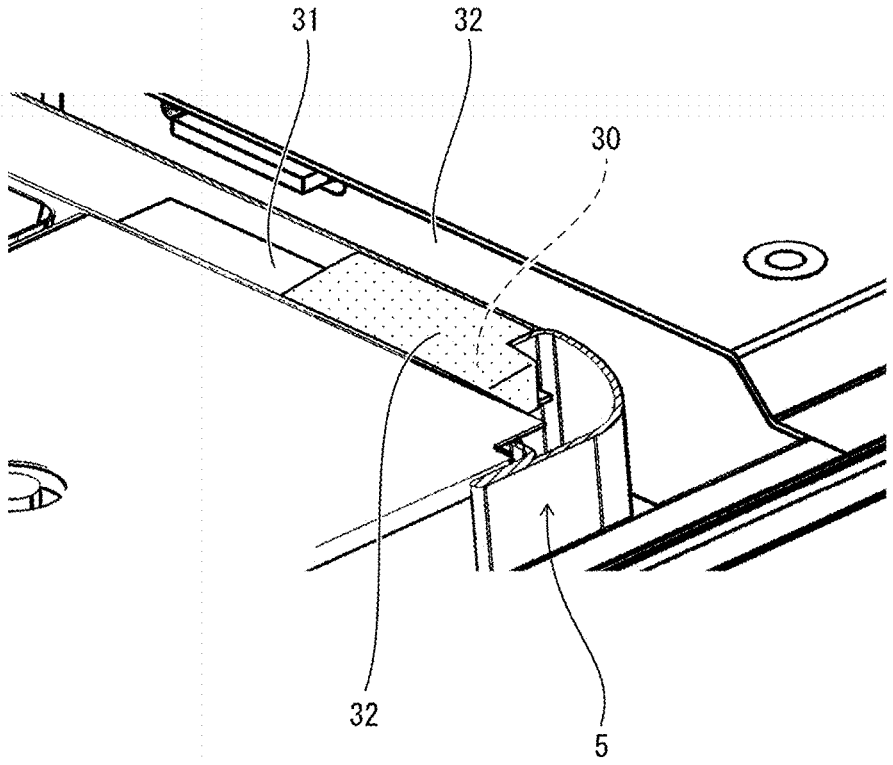
FIG. 10 is an enlarged view of an area B illustrated in FIG. 9.

FIG. 7 is an enlarged view of an area A illustrated in FIG. 1. FIG. 8 is a cross-sectional perspective view illustrating a main part that indicates a position of an opening 30 communicating with an outside of the cabin 5. FIG. 9 is a cross-sectional perspective view illustrating the work machine 1 cut along a horizontal plane. FIG. 10 is an enlarged view of an area B illustrated in FIG. 9.

The cabin 5 is formed by welding combined plate metals which are processed into predetermined shapes such as a curved shape. Thus, in some cases, an opening (gap) that cannot be completely filled occurs, for example, between the plate metals. In other cases, an opening is provided for a reason concerning a production process. As an example of such an opening, as illustrated in FIGS. 7 and 8, a relatively large opening 30 communicating with the outside of the cabin 5 is present on a lower side of a frame 5*c* on a right side of a rear portion of the cabin 5.

This opening 30 inevitably occurs when a space 31 is provided at the right-side portion of the rear portion of the cabin 5 at which the frame 5*c* is located. The space 31 is a space through which a harness for wiring arrangement around a ceiling of the cabin 5 passes. The opening 30 communicates with the inside and the outside of the cabin 5. The space 31 is a space communicating with the inside of the cabin 5. In the space 31, a harness for a front light and a rear light which are mounted to an upper portion of the cabin 5 is installed.

Such an opening 30 faces the space 31 communicating with the inside of the cabin 5 and thus serves as a path that lets an outside noise pass therethrough. This causes the outside noise to enter the cabin 5 through the opening 30. FIG. 8 illustrates a state where any measure has not yet been carried out on the opening 30.

FIG. 9 is a cross-sectional perspective view illustrating the work machine 1 cut along a horizontal plane. FIG. 10 is an enlarged view of an area B illustrated in FIG. 9. FIGS. 9 and 10 each illustrate a state where a measure has been carried out on the opening 30. In order to prevent a noise from entering the cabin 5 through the opening 30, the work machine 1 has an expandable member 32, disposed in the opening 30, for filling the opening 30, as illustrated in FIGS. 9 and 10. The disposition of the expandable member 32 fills the opening 30. This makes it possible to prevent an outside noise from entering the cabin 5 from the opening 30 through the space 31.

Figure 11:
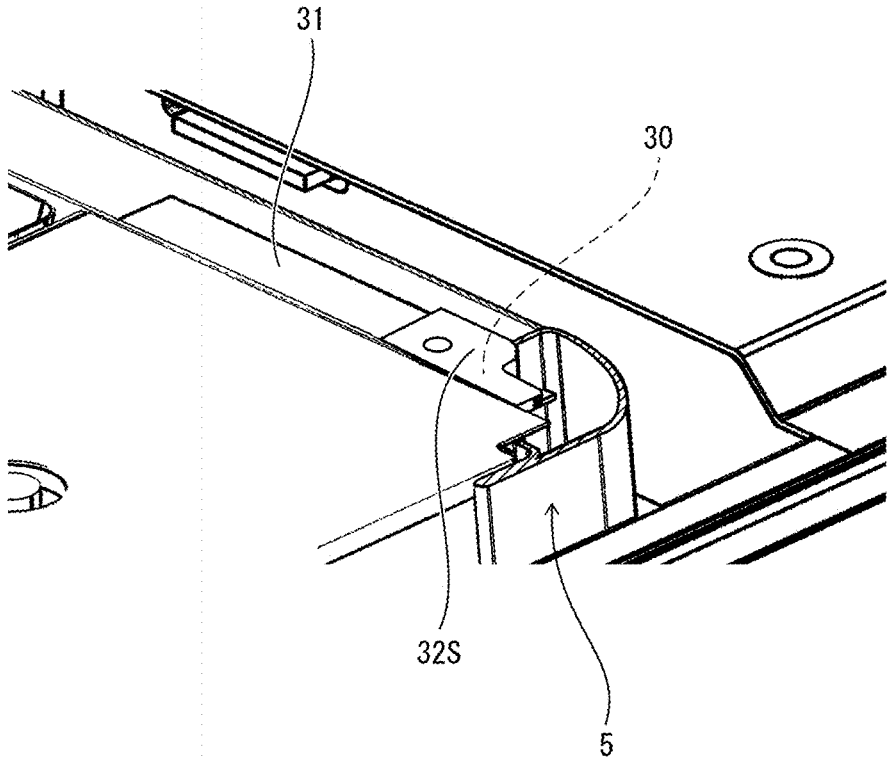
FIG. 11 is a view illustrating a state in which an expandable sheet that has not yet been expanded is disposed in the opening.

In such a configuration of filling the opening 30 with use of the expandable member 32, the expandable member 32 can be expanded by utilizing heat generated in a step of drying a coating applied to the cabin 5. That is, as illustrated in FIG. 11, an expandable sheet 32S cut into the shape of the opening 30 is disposed in the opening 30 in advance before the step of drying a coating of the cabin 5. The expandable sheet 32S is then expanded to fill the opening 30, by utilizing heat generated in the step of drying the coating applied to the cabin 5. FIG. 11 is a view illustrating a state in which the expandable sheet 32S that has not yet been expanded is disposed in the opening 30.

Note that, here, the opening 30 that faces the space 31 through which the harness for wiring arrangement around the ceiling passes is taken as an example of an opening which can be a path that lets a noise enter the cabin 5. However, there is no limitation on such an opening. That is, any opening (gap) which can structurally be a path that lets a noise enter the cabin 5 can be filled by utilizing heat generated in a step of drying the coating applied to the cabin 5, by disposing the expandable sheet 32S cut into the shape of the opening (gap), in the opening (gap) in advance.

Aspects of the present invention can also be expressed as follows:

A work machine in accordance with an aspect of the present invention includes: a machine body; a footplate installed on the machine body; and a cabin installed on the footplate, wherein the cabin has, at a bottom portion of a peripheral wall of the cabin, a mounting portion extending toward an inner side of the cabin and is fixed to the footplate by screwing the mounting portion to an outer edge portion of the footplate at screwed portions in a state where the mounting portion is in contact with the outer edge portion, and a sealing material is disposed between the mounting portion and the outer edge portion in a state where the sealing material elastically deforms.

According to the above configuration, even when a gap occurs due to bending of the footplate, the sealing material can fill the gap by being restored to its original shape. This makes it possible to prevent an outside noise from entering the cabin through the gap caused by the bending of the footplate.

A work machine in accordance with an aspect of the present invention may be configured such that the sealing material is provided between the mounting portion and the outer edge portion and is disposed in a location between the screwed portions.

According to the above configuration, the sealing material is disposed only in a location in which a gap may occur. This makes it possible to prevent waste of the sealing material.

A work machine in accordance with an aspect of the present invention may be configured such that one of the mounting portion and the outer edge portion has, in the location between the screwed portions, a step portion forming a level difference in a direction away from the other one of the mounting portion and the outer edge portion, and the sealing material is disposed in the step portion.

According to the above configuration, it is possible to allow the sealing material to be thick and thus provides an adequate amount by which the sealing material is crushed. Thus, even when the gap changes in size due to a change in amount of bending of the footplate, the sealing material changes its shape and size with the change in size of the gap, and fills the gap.

A work machine in accordance with an aspect of the present invention may be configured such that the step portion is provided in the outer edge portion, and the step portion includes: a notch portion extending along an outer edge of the footplate; and a support plate being fixed to a lower surface of the footplate and covering the notch portion from a lower surface side of the footplate. According to the above configuration, it is possible to easily achieve the step portions.

A work machine in accordance with an aspect of the present invention may be configured such that the footplate has a substantially quadrangular shape, the mounting portion is screwed to the footplate at four corners of the footplate, and the sealing material is disposed at each of end portions of the footplate except for the four corners.

According to the above configuration, in a configuration in which the mounting portion is screwed to the footplate at the four corners of the footplate, it is possible to fill gaps in four directions caused by the bending of the footplate.

A work machine in accordance with an aspect of the present invention may be configured such that, in an opening that faces a space communicating with an inside of the cabin, an expandable member for filling the opening is disposed.

According to the above configuration, it is possible to prevent an outside noise from entering the cabin from the opening through the space.

A work machine in accordance with an aspect of the present invention may be configured such that the space is a space for allowing a harness for an electronic component to pass therethrough.

According to the above configuration, it is possible to prevent an outside noise from entering the cabin from the opening for drawing the harness to the outside.

The present invention is not limited to the embodiments, but can be altered by a skilled person in the art within the scope of the claims. The present invention also encompasses, in its technical scope, any embodiment derived by combining technical means disclosed in differing embodiments.

REFERENCE SIGNS LIST

1 Work machine
3 Machine body
4 Work device
5 Cabin
5*a* Mounting portion
20 Operator seat
21 Footplate
21*a* Outer edge portion
23 Support plate
24 Step portion
25 Sealing material
30 Opening
31 Space
32 Expandable member

The invention claimed is:

1. A work machine comprising:

a machine body;

a footplate installed on the machine body; and a cabin installed on the footplate, wherein the cabin has, at a bottom portion of a peripheral wall of the cabin, a mounting portion extending toward an inner side of the cabin and is fixed to the footplate by screwing the mounting portion to an outer edge portion of the footplate at screwed portions in a state where the mounting portion is in contact with the outer edge portion, a sealing material is disposed between the mounting portion and the outer edge portion in a state where the sealing material elastically deforms; and at the screwed portions, the mounting portion is in direct contact with the outer edge portion;

wherein the sealing material is provided between the mounting portion and the outer edge portion and is disposed in a location between the screwed portions.

2. A work machine comprising:

a machine body;

a footplate installed on the machine body; and a cabin installed on the footplate, wherein the cabin has, at a bottom portion of a peripheral wall of the cabin, a mounting portion extending toward an inner side of the cabin and is fixed to the footplate by screwing the mounting portion to an outer edge portion of the footplate at screwed portions in a state where the mounting portion is in contact with the outer edge portion, and a sealing material is disposed between the mounting portion and the outer edge portion in a state where the sealing material elastically deforms;

wherein the sealing material is provided between the mounting portion and the outer edge portion and is disposed in a location between the screwed portions wherein one of the mounting portion and the outer edge portion has, in the location between the screwed portions, a step portion forming a level difference in a direction away from the other one of the mounting portion and the outer edge portion; and wherein the sealing material is disposed in the step portion.

3. The work machine according to claim 2, wherein:

the step portion is provided in the outer edge portion; and the step portion includes:

a notch portion extending along an outer edge of the footplate; and a support plate being fixed to a lower surface of the footplate and covering the notch portion from a lower surface side of the footplate.

4. The work machine according to claim 1, wherein:

the footplate has a substantially quadrangular shape; the mounting portion is screwed to the footplate at four corners of the footplate; and the sealing material is disposed at each of end portions of the footplate except for the four corners.

5. The work machine according to claim 1, wherein, in an opening that faces a space communicating with an inside of the cabin, an expandable member for filling the opening is disposed.

6. The work machine according to claim 5, wherein the space is a space for allowing a harness for an electronic component to pass therethrough.

7. The work machine according to claim 2, wherein:

the footplate has a substantially quadrangular shape; the mounting portion is screwed to the footplate at four corners of the footplate; and the sealing material is disposed at each of end portions of the footplate except for the four corners.

8. The work machine according to claim 2, wherein, in an opening that faces a space communicating with an inside of the cabin, an expandable member for filling the opening is disposed.

9. The work machine according to claim 8, wherein the space is a space for allowing a harness for an electronic component to pass therethrough.

* * * * *